US005183086A

United States Patent [19]

Fanta et al.

[11] Patent Number: 5,183,086

[45] Date of Patent: Feb. 2, 1993

[54] ENCAPSULATION METHOD FOR THE CONTAINMENT OF WASTE AND SALVAGEABLE PRODUCTS

[75] Inventors: David E. Fanta, Westlake, La.; Johnnie L. Hamby, Manvel; Hart E. Schleicher, Houston, both of Tex.

[73] Assignee: Allwaste Services, Inc., Houston, Tex.

[21] Appl. No.: 863,499

[22] Filed: Mar. 30, 1992

Related U.S. Application Data

[63] Continuation of Ser. No. 573,453, Aug. 27, 1990, abandoned.

[51] Int. Cl.[5] ..... B65B 1/12

[52] U.S. Cl. ..... 141/10; 141/5; 141/7; 141/59; 141/65; 141/114; 141/231; 141/314; 141/316; 220/404

[58] Field of Search ..... 141/5, 7, 8, 10, 59, 141/65, 67, 68, 231, 114, 314, 315, 316, 317; 220/407, 404

[56] References Cited

U.S. PATENT DOCUMENTS

| | | | |
|---|---|---|---|
| 1,401,419 | 12/1921 | McNally | 410/135 |
| 1,499,229 | 6/1924 | Laffey | 410/135 |
| 1,815,653 | 7/1931 | Jones . | |
| 2,144,181 | 1/1939 | Du Bois | 226/48 |
| 2,712,797 | 7/1955 | Woehrle et al. | 105/367 |
| 2,748,673 | 6/1956 | Winstead | 93/35 |
| 2,783,786 | 3/1957 | Carter | 141/51 |
| 2,815,621 | 12/1957 | Carter | 141/59 X |
| 2,896,839 | 7/1959 | Barnes et al. | 229/62 |
| 2,931,523 | 4/1960 | Nelligan | 214/82 |
| 2,956,839 | 10/1960 | Hermanns | 302/53 |
| 3,087,491 | 4/1963 | Gewecke et al. | 128/272 |
| 3,105,617 | 10/1963 | Felldin | 222/185 |
| 3,163,544 | 12/1964 | Valyi | 99/171 |
| 3,170,600 | 2/1965 | Pierson | 222/94 |
| 3,173,573 | 3/1965 | Donegan | 220/93 |
| 3,199,726 | 8/1965 | Pierson | 222/1 |
| 3,201,000 | 8/1965 | Hermanns | 222/193 |
| 3,273,761 | 9/1966 | Langen | 222/386.5 |
| 3,275,197 | 9/1966 | Eklund | 222/195 |
| 3,298,156 | 1/1967 | Lerner | 53/29 |
| 3,309,007 | 3/1967 | Rosenberg et al. | 229/55 |
| 3,351,235 | 11/1967 | Paton | 222/1 |
| 3,384,106 | 5/1968 | Isbrandtsen | 137/269 |
| 3,421,665 | 1/1969 | Paton | 222/386.5 |
| 3,542,091 | 10/1970 | Carter | 141/68 |
| 3,590,888 | 7/1971 | Coleman | 141/5 |

(List continued on next page.)

OTHER PUBLICATIONS

"Action in the End Zone: A Bigger Covered Hopper", *Railway Age*, Jul. 28, 1969, p. 25.

*Primary Examiner*—Ernest G. Cusick

*Attorney, Agent, or Firm*—Arnold, White & Durkee

[57] ABSTRACT

The present invention is directed to a system to collect and encapsulate bulk waste products or salvageable materials for purposes of storage and/or transportation and ultimate disposal. More specifically, the present invention comprises a sealable support structure which is provided with an air intake and exhaust so as to create air flow through said structure and a fitted liner disposed in said structure where said liner is disposed in fluid with said intake and exhaust. The air exhaust is coupled to a positive displacement blower, centrifugal fan or other similar air moving device. The air intake is coupled to a flexible conduit through which material is transported to the liner. Preferably, the liner is maintained in an open position by the creation of negative pressure about its exterior during the filling process.

4 Claims, 2 Drawing Sheets

FOREIGN PATENT DOCUMENTS

| | | | |
|---|---|---|---|
| 1205106 | 5/1986 | Canada . | |
| 0276994 | 8/1988 | European Pat. Off. . | |
| 2161631 | 6/1973 | Fed. Rep. of Germany . | |
| 2548135 | 1/1985 | France | 141/67 |

1089874 11/1967 United Kingdom .
1241162 7/1971 United Kingdom .
2110192 6/1983 United Kingdom .

OTHER PUBLICATIONS 3,604,578 9/1971 Smith ..... 214/500
3,680,560 8/1972 Pannier, Jr. et al. ..... 128/276
3,721,603 3/1973 Takeda ..... 383/107 X
3,726,067 4/1973 Fesco ..... 55/367
3,780,738 12/1973 Deaton ..... 128/277
3,814,098 6/1974 Deaton ..... 128/276
3,822,919 7/1974 Strom ..... 302/47
3,941,258 3/1976 Ide ..... 214/17
3,951,284 4/1976 Fell et al. ..... 141/10 X
3,980,196 9/1976 Paulyson et al. ..... 220/1.5
4,054,161 10/1977 Alack ..... 141/12
4,054,226 10/1977 Bjelland et al. ..... 220/63
4,083,607 4/1978 Mott ..... 141/67 X
4,098,425 7/1978 Yamamoto ..... 220/403
4,124,136 11/1978 Bjelland et al. ..... 220/68
4,170,946 10/1979 Youness ..... 105/493
4,232,803 11/1980 Muller et al. ..... 222/105
4,321,922 3/1982 Deaton ..... 128/276
4,334,812 6/1982 Delatush ..... 410/52
4,344,468 8/1982 Sandberg ..... 141/69
4,345,862 8/1982 Blout et al. ..... 410/134
4,358,233 11/1982 Morris et al. ..... 410/127
4,399,737 8/1983 Severson ..... 98/6
4,421,250 12/1983 Bonerb et al. ..... 222/95
4,430,084 2/1984 Deaton ..... 604/317
4,441,627 4/1984 Takeuchi ..... 220/461
4,461,402 7/1984 Fell et al. ..... 222/105
4,498,824 2/1985 Kinkle ..... 410/121
4,556,349 12/1985 Koudstaal et al. ..... 410/140
4,595,126 6/1986 Holmes ..... 222/105
4,673,112 6/1987 Bonerb ..... 222/386.5
4,703,782 11/1987 Henkel, Sr. ..... 141/65
4,784,287 11/1988 Yamada et al. ..... 220/403
4,828,187 5/1989 Davis et al. ..... 220/404 X
4,854,801 8/1989 Bonerb ..... 414/291
4,913,321 4/1990 Abboud ..... 222/195
5,010,943 4/1991 Boyer ..... 160/351

ENCAPSULATION METHOD FOR THE CONTAINMENT OF WASTE AND SALVAGEABLE PRODUCTS

This application is a continuation of application Ser. No. 07/573,453, filed Aug. 27, 1990, entitled Encapsulation System for the Containment of Waste and Salvageable Products, now abandoned.

BACKGROUND OF THE INVENTION

1. Field of the Invention

The present invention is directed to a system for collecting and encapsulating bulk waste or salvageable products. More specifically, the present invention is directed to a system to collect a variety of bulk materials, including hazardous waste materials, utilizing principals of pneumatic conveyance.

2. Background

A variety of industries generate significant quantities of waste by-products as a normal part of their day-to-day operation. In most instances, these materials must be periodically removed and transported to a waste disposal, reclamation or treatment site or other similar facility. Such materials may include silica powders, fly ash, sludges, asbestos-containing materials, spent catalyst components, and more mundane materials such as bricks, grease or woodchips.

Collection, transportation and disposal of waste products is both expensive and labor intensive. Traditionally, removal and transportation of dry waste products was carried out via the use of heavy, conventional machinery such as front-end loaders and open carriers. The use of such machinery, however, had a number of disadvantages. If a finely particulated material such as silica powder was involved, the use of open equipment often resulted in an undesirable creation of dust. This creation of dust often posed a danger to equipment, operating personnel and the environment. The use of such machinery also did not lend itself to use with sludges or other liquid or semi-solid wastes. Importantly, conventional removal and transportation techniques generally necessitated rigorous decontamination of both the equipment and personnel involved in the clean-up operation. The efforts directed toward such decontamination were especially pronounced when the waste products included asbestos or other known contaminants.

Other prior art collection and removal systems include vacuum-type removal apparatus. Vacuum-type mechanisms have long been used to collect a variety of liquid and semi-solid type waste. Conventional vacuum-type collection systems, however, generally cannot be used where the vacuum operation involves a significant head height, e.g., a head height in excess of approximately 30 feet. Moreover, such vacuum systems have little if any application to the collection of particulate-type waste products such as sands or powders.

In approximately 1979, assignee Allwaste Services of Texas, Inc. developed a system which enabled the collection of bulk material in a roll-off container modified to operate in association with a conventional air mover. Air moving is generally defined as a vacuuming process by which waste or salvageable materials are removed by means of pneumatic conveyance (i.e., vacuuming with controlled air velocity). An air moving truck (i.e., air mover) uses either a positive displacement blower or centrifugal fan to provide the movement or velocity of air. In these early designs, air was exhausted from the container by means of the air mover, which resulted in the creation of suction through an air intake. When a hose or pipe was coupled to this air intake, both liquid and solid materials could be conveyed through the hose or pipe and collected in the container.

In these early designs, the collection container was adapted to receive a liner which was suspended from its interior via a series of mounting hooks. When the container was filled, it was transported to the dump site via a roll-off truck or trailer whereby the liner and its contents were "dumped" from the container. This was normally carried out by inclining the container on the roll-off truck in a conventional fashion. Due to the nature of the liner and its mounting in the container, however, removal of the liner and its contents often resulted in contamination of the container interior. As a result of such contamination, the interior of the container necessitated costly cleaning after each use. Predictably, such contamination was undesirable in instances involving hazardous compounds such as asbestos or the like. Additionally, such contamination posed the possibility of damage to the container when the waste materials or salvageable compounds involved corrosive compounds.

SUMMARY OF THE INVENTION

The present invention addresses the above noted and other disadvantages of prior art collection operation by presenting a collection system which enables the ready encapsulation of liquid, semi-solid and solid materials. Once encapsulated, the materials may be stored and/or transported to a disposal site or the like independently of the support mechanism in which it may have been collected.

The encapsulation system of the present invention generally comprises a sealable support structure which is provided with a means to establish and maintain high velocity, high volume, negative pressure air movement therethrough. In accordance with the present invention, the support structure must also be able to withstand the creation and maintenance of a negative pressure state. In a preferred embodiment, air is evacuated from the support structure via an air mover. In a complementary fashion, air is pulled through the support structure via an air intake which is coupled to a flexible collection tube or the like.

A fitted liner is preferably disposed inside the support structure so as to exist in flow communication with the air intake and exhaust. In such a fashion, materials entrained in the airflow moving through the support structure will be deposited in the liner. During the filling operation, the liner is held open by negative pressure created in the annular space between the liner and the support structure. The liner is preferably provided with an extension or neck which provides the opening for the material to enter the liner. This neck may be sealed when the liner is filled. When sealed, the liner may be removed from the support structure and transported in a conventional flat bed trailer or the like or hauled in the roll-off container.

The present invention has a number of advantages over the art. One such advantage is the capability to remove and encapsulate a liquid or particulate material while substantially reducing the creation of dust during the collection, transportation and ultimate disposal of the material. A second advantage is the ability to reduce or substantially eliminate contamination of the liner support structure such that cleaning or decontamination efforts are largely unnecessary. Yet another advantage is the ability to effectively trap odors from the waste product in the liner.

Other advantages include the long range cost reductions allowed by the present system. Cost savings are achieved by reducing the amount of transportation and other support systems necessary to complete an on-site cleanup or collection effort. This is possible since the liners are structurally independent when full and may be collected at a job site prior to disposal. Cost savings are also achieved by substantially eliminating decontamination of the support structure. Damage to the support structure is also reduced or eliminated by the use of impermeable liners which prevent the drainage of most corrosives.

Other advantages and benefits of the present invention will become obvious in view of the following description and accompanying drawings.

DETAILED DESCRIPTION OF PREFERRED EMBODIMENT

The present invention is generally directed to a portable collection system which enables the encapsulation of solid, semi-solid and liquid materials while substantially reducing contamination of equipment involved in such collection efforts. The present invention also reduces contamination to the environment during collection activities.

Figure 1:
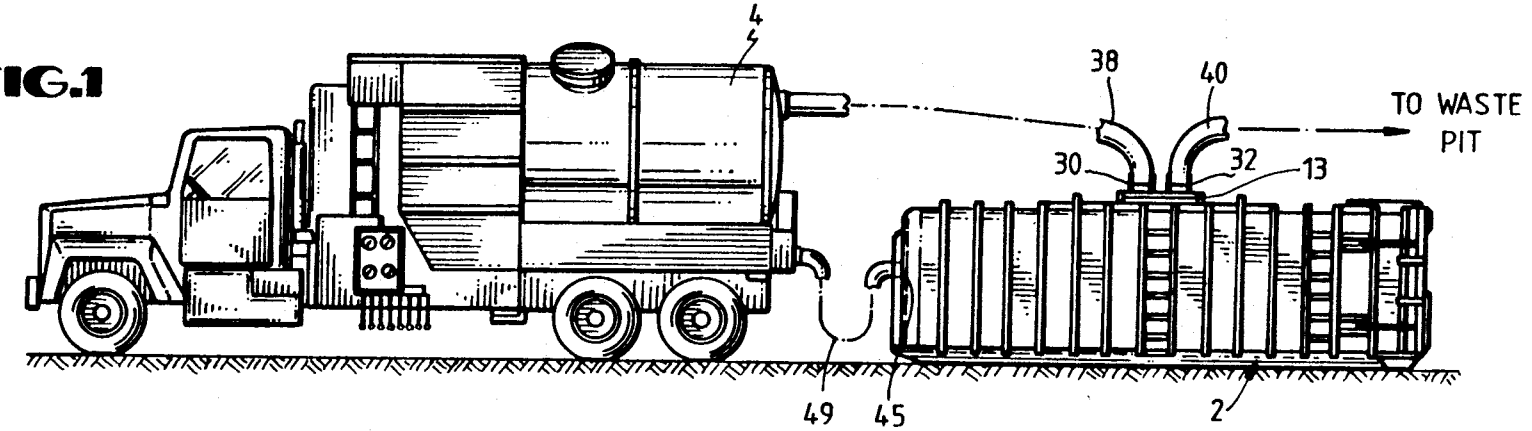
FIG. 1 illustrates a side view of one preferred embodiment of the invention in reference to a conventional air mover.

One embodiment of the present invention may be seen by reference to FIG. 1. FIG. 1 illustrates a support structure 2 which is positioned in its normal operating relationship relative to a conventional high volume, high velocity air mover 4 such as a positive displacement blower unit manufactured by Guzzler Manufacturing of Birmingham, Ala. Alternatively, a centrifugal fan unit such as one manufactured by Central Engineering of Oshkosk, Wis. may be employed. Support structure 2 is preferably transported to and from the job site mounted on a conventional tractor trailer or truck adapted to carry a roll-off container. Though structure 2 is illustrated as being elongate in configuration, many other shapes are envisioned within the scope of the present invention. It is desirable, however, that support structure 2 have a shape compatible with readily available conveyance means such as conventional roll-off truck and trailer rigs.

Figure 2:
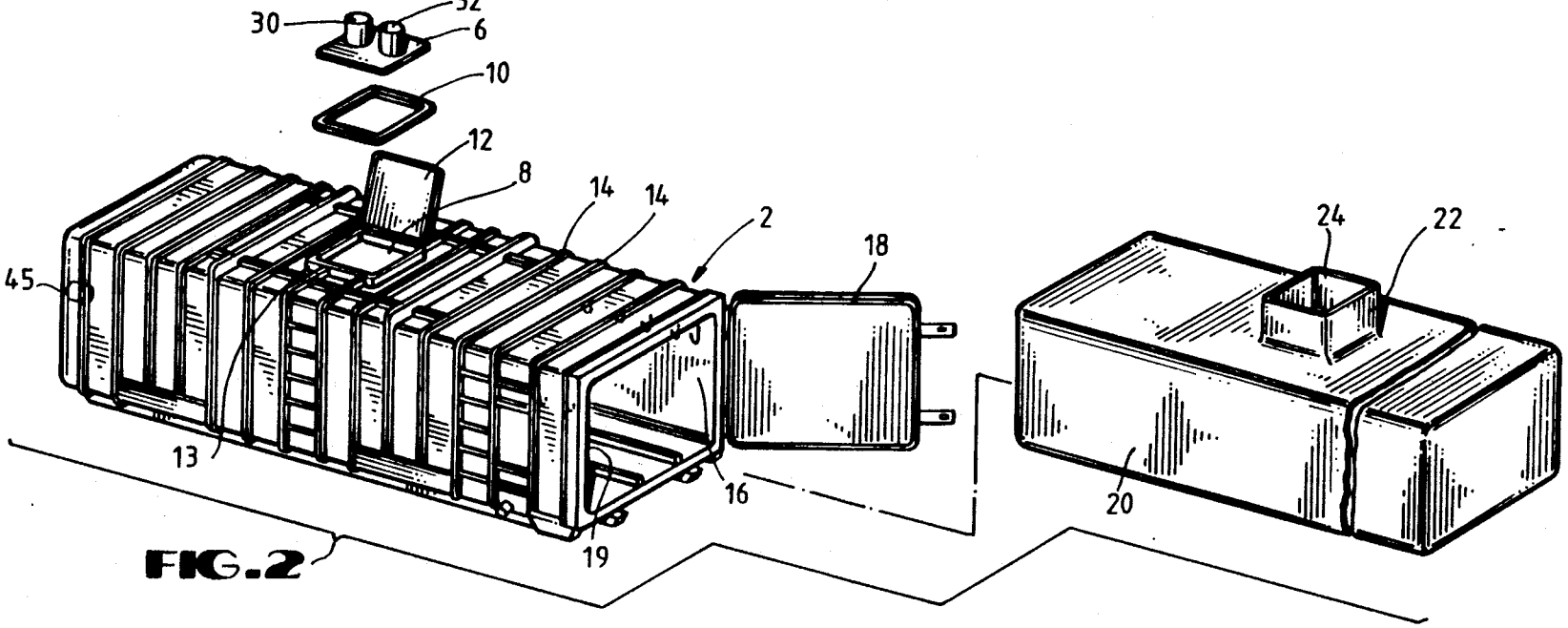
FIG. 2 illustrates an exploded, perspective view of the embodiment of FIG. 1 further illustrating one embodiment of a liner.
Figure 3:
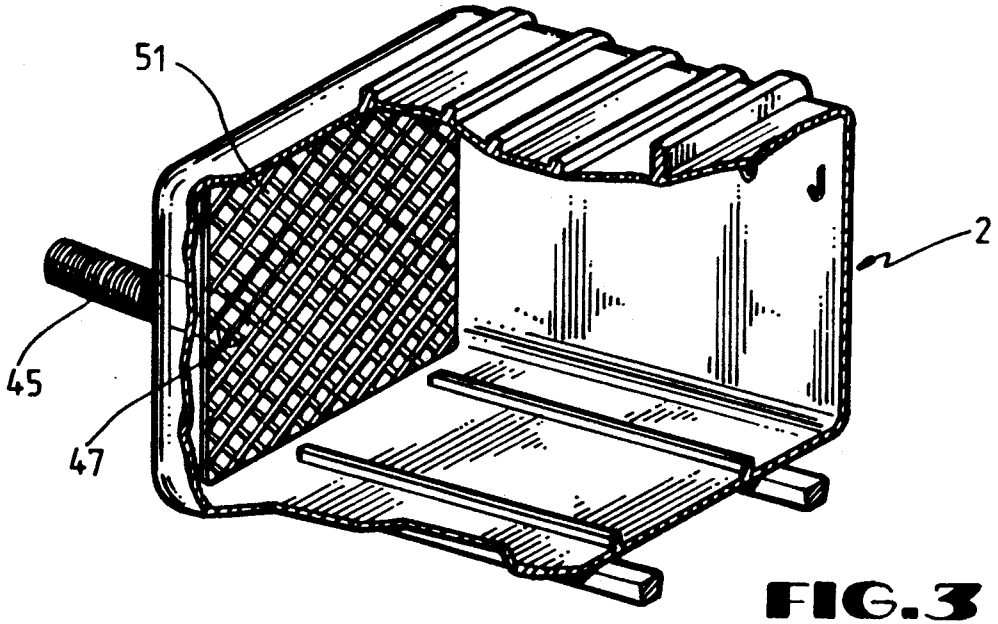
FIG. 3 illustrates a perspective, cutaway view of a the embodiment of FIG. 1.

A more detailed view of support structure 2 may be seen by reference to FIGS. 2-3. Support structure 2 generally comprises a specialized vacuum roll-off container such as those manufactured by May-Fab of Beeville, Tex., or Modern Equipment of Beaumont, Tex., which has been modified to accept a splitter assembly 6 securable to a sealable hatch or manway 8. To establish a tight seal between assembly 6 and structure 2 it is desirable to include a gasket 10 or the like which may be constructed of conventional materials and formed to fit hatch 8. When assembly 6 is not in place, as for example when structure 2 is being moved to a collection or dump site, hatch 8 may be secured via hatch 12. In a preferred embodiment, support structure 2 is ribbed 14 for purposes of structural integrity. Support structure 2 is also provided with an opening 16 at one end in a generally conventional fashion, where said opening 16 is securable via a door or hatch 18.

Support structure 2 is adapted to furnish support for an inflatable liner. A preferred embodiment of a liner is presented in FIGS. 2-3. In a preferred embodiment, liner 20 is substantially form fitted to the interior 19 of structure 2. In this connection, liner 20, when inflated, substantially describes an elongate parallelogram which is provided with an upwardly extending neck or throat 22 defining an aperture 24 therethrough. Preferably aperture 24 has a circumference slightly larger than the circumference of hatch 8 so as to enable neck 22 to be fitted through said hatch 8 and secured beneath assembly 6. It is envisioned that neck 22 may be folded over the top of a lip 13 which bounds the uppermost portion of hatch 8 as illustrated. Neck 22 may be held in place by the sheer weight of assembly 6. Alternatively, assembly 6 may be secured via a conventional clamping or fastening arrangement (not shown).

Splitter assembly 6 generally comprises a fitted plate which is provided with an intake connector 32 and exhaust connector 30. For purposes of operation, exhaust connector 30 is coupled to air mover 4 via an appropriately sized conduit 38. In a preferred embodiment, an eight (8) inch non-collapsible conduit may be used although it will be understood a variety of differently sized and configured hoses or pipes may also be employed within the spirit of the present invention. A similarly sized and configured conduit 40 is coupled to air intake 32. The free end of conduit 40 is appropriately shaped to aide in the end application of the present collection system as will be further described herein.

Liner 20 is preferably fitted within support structure 2 while liner 20 is in a substantially collapsed condition. For purposes of convenience, the placement of liner 20 may be accomplished via opening 16. When liner 20 has been properly situated within structure 2, hatch 18 is moved to a closed and sealed position. To facilitate sealing, hatch 18 may be provided with conventional seals or gaskets (not shown). Prior to inflation, neck 22 of linear 20 is pulled upwardly through aperture 8 and is fitted around lip 13. Splitter assembly 6 and gasket 10 is then fitted over lip 13 and secured in place.

When actuated, air mover 4 produces a high volume, high velocity negative pressure air flow. This flow serves to exhaust structure 2 and linear 20 so as to create a significant suction through conduit 40. In such a fashion, all manner of particles, semi-solids and liquids may be entrained in the air flow moving through structure 2. This collected matter is deposited in liner 20 as the rapidly moving air slows upon encountering the void of the interior of said liner 20. In a preferred embodiment, positive displacement blowers utilized in accordance with the invention generate 10-18 inches of mercury vacuum pressure and 3,000-6,000 cfm. Alternately, centrifugal fan units used with the invention preferably generate 3-6 inches of mercury and 12,000-22,000 cfm. Given the performance of such air movers, wet or dry materials may be moved as far as 700 horizontal feet and 75-100 vertical feet depending on the weight and physical size of the material.

As noted, the operation of air mover 4 serves to create negative pressure in liner 20. If not compensated for this negative pressure would quickly collapse liner 20 and render further collection efforts impossible. To compensate for this negative pressure, and to achieve inflation of liner 20 in the first instance, it is desirable to first create an area of negative pressure exterior to liner 20. This negative pressure is achieved by evacuating the interior of structure 2 exterior to liner 20. (See FIG. 3). In one embodiment of the invention illustrated in FIG. 3, the anterior end of support structure 2 opposite door 18 is provided with an aperture 47 which is operatively coupled to a secondary exhaust portal 45. Exhaust portal 45 is adapted to connect to air mover 4 via a secondary conduit 49. A screen 51 or similar device may be secured over aperture 47 to prevent liner 20 from being drawn into aperture 47 during operation of air mover 4.

In operation, air is first exhausted from the interior of structure 2 through aperture 47 and secondary exhaust portal 45 and secondary conduit 49. This serves to create an area of negative pressure exterior to liner 20 which results in the liner's inflation. Subsequent to the inflation of liner 20, air flow is induced through liner 20 via splitter assembly 6 as previously described. During operation, however, it is desired that a negative pressure state be maintained on the exterior of liner 20 which is at most equal to, and preferably less than, the pressure developed in the interior of liner 20.

As noted, liner 20 is preferably fitted to the interior of support structure 2 whether such structure represents an elongate configuration as illustrated, or other configurations. It is preferred, however, that liner 20 possess an inflated size slightly larger than the interior of structure 2. This is desirable so as to allow a substantially balanced negative pressure state around the exterior of liner 20. When the liner is exactly tailored to the inside dimensions of support structure 2, there exists the possibility that liner 20 will form a seal against the interior of structure 2, thus preventing a balanced negative pressure state. It is also desirable that liner 20 not possess overall dimensions smaller than the interior dimensions of structure 2, since unsupported inflation of an undersized liner may also result in damage to the liner itself.

The configuration of liner 20 is variable both on the configuration of structure 2 as well as the intended end application of the collection system. In one preferred embodiment, it is contemplated that the liner will consist of a 3–5 ounce woven polypropylene fabric interiorly coated with polypropylene. Such a bag is manufactured by the B.A.G. Corporation of Dallas, Tx. Alternatively, a 6–9 mil thickness polyethylene bag may be used such as manufactured by PAC-TEC, Inc. of Clinton, La.

What I claim is:

1. A method for encapsulating waste materials, comprising the steps of:

(a) positioning a substantially collapsed polyethylene liner having an open neck portion, into the interior of an enclosed rigid container having an open neck portion and at least one openable side wall;

(b) extending the liner neck portion through the container neck portion and securing it thereto;

(c) positioning a first conduit and a second conduit through the container neck portion and into the liner;

(d) creating a negative pressure air flow between the container and the liner whereby the liner is inflated to fill the container and fit snugly in the interior of the container;

(e) creating a negative pressure air flow in the first conduit such that waste materials are drawn into the liner through the second conduit;

(f) removing the liner neck portion from the container neck portion;

(g) closing and sealing the liner neck portion; and (h) at least one wall opening the openable side of the container and slidably removing the liner therefrom.

2. The method of claim 1 wherein the enclosed rigid container is a portable roll-off container mountable on a tractor trailer.

3. The method of claim 1 further comprising the step of tilting the enclosed rigid container to slidably remove the liner therefrom.

4. The method of claim 1 wherein the enclosed rigid container is sealed.

* * * * *